United States Patent [19]

Chung

[11] 4,184,141

[45] Jan. 15, 1980

[54] SLOW SOCKET

[76] Inventor: Kyung-Cho Chung, 402 Rindge Ave., Cambridge, Mass. 02140

[21] Appl. No.: 890,585

[22] Filed: Mar. 20, 1978

[51] Int. Cl.[2] ..... H01H 3/02; H01H 1/36; H01H 9/00

[52] U.S. Cl. ..... 338/219; 200/51.14

[58] Field of Search ..... 338/70, 215, 219; 200/51.14, 51.15, 51.16

[56] References Cited

U.S. PATENT DOCUMENTS

| | | | |
|---|---|---|---|
| 1,228,635 | 6/1917 | Alexander | 338/219 |
| 2,006,195 | 6/1935 | Cook | 200/51.15 X |
| 2,075,436 | 3/1937 | Grossman et al. | 200/51.15 X |
| 3,028,523 | 4/1962 | Seid | 338/215 X |
| 3,333,224 | 7/1967 | Rosenblatt | 338/219 |
| 3,372,302 | 3/1968 | Fasola | 200/51.14 X |
| 3,930,183 | 12/1975 | Harnden | 338/219 X |

FOREIGN PATENT DOCUMENTS

| | | | |
|---|---|---|---|
| 414273 | 8/1934 | United Kingdom | 338/215 |

*Primary Examiner*—Herbert F. Ross
*Attorney, Agent, or Firm*—James J. Cannon, Jr.

[57] ABSTRACT

A unique light-bulb switch socket which can accommodate conventional light bulbs and is actuated by either a pull chain or a pushbutton switch. This socket allows current to build up gradually when the bulb is turned on, rather than abruptly as in conventional sockets, resulting in longer bulb lifetimes and reduced eyestrain. The socket uses a special spring-and-cam mechanism to accomplish its function.

3 Claims, 8 Drawing Figures

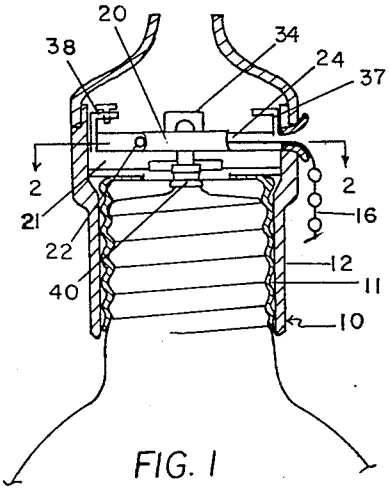
FIG. 1
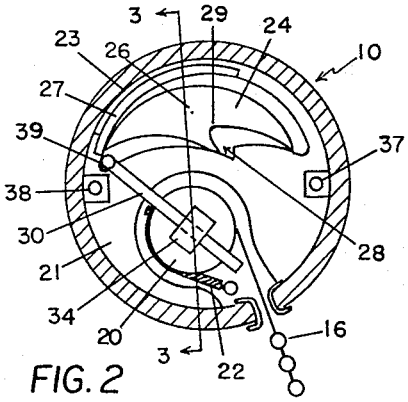
FIG. 2
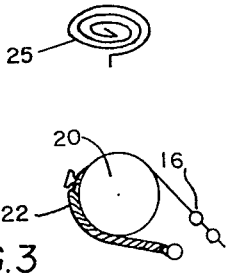
FIG. 3
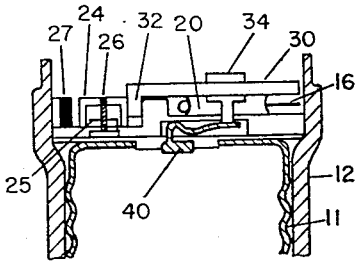
FIG. 4
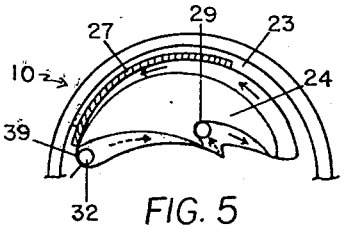
FIG. 5
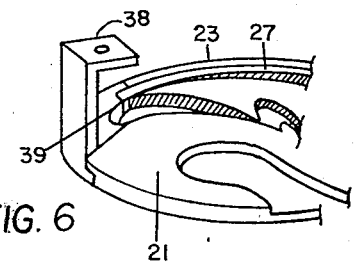
FIG. 6
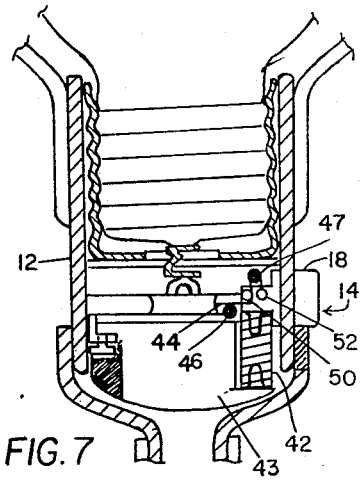
FIG. 7
FIG. 8
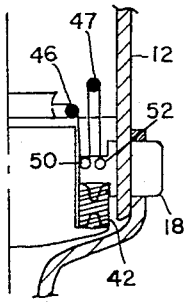
FIG. 9
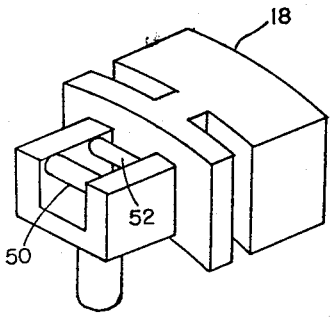
FIG. 10
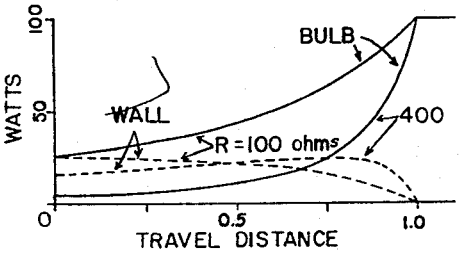

SLOW SOCKET

FIELD OF THE INVENTION

This invention relates to electric-socket switches for light bulbs, and more particularly, to an electric socket-switch that is controlled by spring and cam action to cause current to build up gradually rather than abruptly.

DESCRIPTION OF THE PRIOR ART

Electric bulb sockets that have a chain or pushbutton actuating mechanism are well known, and have been in use for many years. In these sockets, the chain or pushbutton operates an actuator that opens and closes the electrical circuit that provides power to the bulb. Generally these mechanisms have a latch-on and a latch-off position so that the bulb is alternately switched "on" and then "off" by successive operations of the chain or pushbutton.

The problem with sockets of this type is that they are essentially two-state devices, either totally on or totally off. Consequently they cause current to rise abruptly in the light bulb when it is turned on and drop abruptly when turned off. This abrupt current change, especially at turn-on operation, can have several detrimental effects. For one, it subjects the filament to the strain fatigue of a thermal shock that can significantly shorten its life. As a result the bulb burns out much more rapidly than it would if this abrupt switching was reduced or eliminated. Since this problem is known to many consumers, persons will sometimes leave light bulbs on if they are leaving their homes for only a short period in order to save wear on the bulb due to switching. However, this remedy has its own drawback, namely that it results in a considerable waste of electrical energy.

The abrupt switching also has a detrimental effect on the switch contacts since it induces a large reverse e.m.f. that can cause arcing across the contacts. While sockets are usually designed to withstand arcing, it is possible that if the problem was reduced, it would allow sockets to be fabricated out of less expensive materials and would reduce costs.

Another difficulty caused by abrupt switching is that it can cause eyestrain when a person enters a dark room and switches on the light. If the current (and the illumination) were to build up slowly, eyestrain would be reduced.

Accordingly, the present invention represents a substantial advance in the design of socket switches in that it provides a socket that is actuated by either a pull chain or a pushbutton as with conventional sockets, but which has a mechanism that causes current to build up slowly rather than abruptly.

As will become apparent from the description below, the socket is designed effectively, yet simply enough that it could be assembled and distributed at a cost that would be competitive with conventional sockets. It requires only readily available materials for its fabrication and can be assembled in volume, using standard manufacturing methods.

SUMMARY OF THE INVENTION

Broadly speaking, this invention is a mechanism that can be incorporated into a conventional light bulb socket that has a threaded cylindrical outer body into which the light bulb is screwed. The body forms one electrical contact, and a central contact is also provided. The mechanism is designed to allow current to build up and cut down gradually, typically 10 to 100 times longer than with conventional sockets. It accomplishes this with a unique spring and cam mechanism. The central contact of the bulb is electrically connected to a copper rotor arm which rotates about an axis through a plastic rotor. One end of the rotor arm rides in a specially contoured notch in a plastic cam. The rotor can be activated to turn about its axis by pulling a chain or by pushing a button. A return spring is mounted around the rotor, and another spring is mounted under the cam so that the notched cam rotates in the opposite direction about its central axis.

The inside surface of the wall of the socket housing is lined with a resistive material. The material covers approximately a 90° arc.

The sequence that occurs when the bulb is to be turned on is initiated when the user pulls the activating chain or the pushbutton. This action displaces the rotor against the reverse force of rotor spring. When the chain is released, the rotor arm begins to return along the outside path of the spring mounted notched cam but at a slow controlled rate due to the resistance of the two springs. As the rotor arm slides along the surface of resistive material on the wall of the socket, the resistance in the electric circuit begins to gradually decrease, allowing the current to build up. This process takes place over a well defined period of time that is set by the relative strengths of two opposed springs. When the rotor arm has traversed the entire resistive path, it hits a corner point at which maximum current is being drawn by the bulb.

To turn the bulb off, the chain is pulled again or the button is pushed down again and the rotor arm continues moving along the notched cam. The notch is contoured so that the rotor rests in an "off" position when the light bulb is turned off.

BRIEF DESCRIPTION OF THE DRAWINGS

FIG. 1 is a vertical cross-sectional view of the slow socket of the present invention installed in a conventional light bulb socket having a pull chain.

FIG. 2 is a horizontal cross-sectional view of the slow socket of the present invention, taken along the line 2—2 of FIG. 1.

FIG. 3 shows two wire springs which control the rotor arm speed.

FIG. 4 is a detailed vertical cross-sectional view of the slow socket taken along the line 3—3 of FIG. 2.

FIG. 5 is a top plan view of the notched can around which the rotor arm pin slides.

FIG. 6 is a perspective view of resistive lining imbedded in the plastic wall and connected with a current carrying metal terminal.

FIG. 7 is a cross-sectional view showing an alternate embodiment for a slow socket using a pushbotton switch.

FIG. 8 is a detailed view of the switch and spring of FIG. 7.

DESCRIPTION OF THE PREFERRED EMBODIMENT

Referring now to the drawings, and in particular to FIGS. 1 and 2 which should be read in conjunction with each other, FIG. 1 is a vertical cross-sectional view of a light bulb in a socket having the slow socket 10 of the present invention installed therein. FIG. 2 is a horizontal cross-sectional view of slow socket 10 of FIG. 1 taken along the line 2—2 of FIG. 1 FIGS. 3 through 6 are detailed views of various sections supplementary to FIGS. 1 and 2.

The invention is a slow-acting switch 10 which is installed in a light bulb socket 12 to allow electrical current to build up gradually when a light is turned on by activating its normal switch 14. Activation can be accomplished either with a chain mechanism 16 (as shown in (FIGS. 1 and 2) or by a pushbutton mechanism 18 (as shown in FIGS. 7 and 8). In both embodiments, the actuating spring and cam mechanism to be described hereinafter which operate the electrical circuit and constitute the basis of slow socket switch 10 are identical.

Referring first to the chain operated embodiment illustrated in FIG. 2, it is shown in FIG. 1 that slow socket switch 10 can be adopted for use with a conventional light bulb socket 12 consisting of a cylindrical outer body which is threaded on its interior sidewall and into which a light bulb can be screwed. This cylindrical socket 12 has one terminal 37 from which the electric current flows to the bulb through the interior sidewall 11 which is in contact with the threaded surface of the bulb. The actuating mechanism of slow socket switch 10 to be described controls the opening and closing of the central contact of the bulb.

In FIG. 2 it is seen that there is a disc rotor 20 which can rotate about an axis through its center with respect to the base of the housing 21 as can be seen in FIGS. 1, 4 and 6. Rotor 20 is fabricated out of a suitable plastic material having the required strength and durability. A spiral wire spring 22 is placed around the rotor 20, as shown in FIG. 3. Spring 22 tends to impart a counter clockwise motion to rotor 20.

Referring back to FIG. 2, in the position shown slow socket switch 10 is in its "on" position and full current would be flowing to the bulb. A notched cam 24 is provided and mounted about a pin 26 which is spring mounted (the spring 25 in FIG. 4) so that the notched cam 24 tends to rotate in the clockwise direction. The motion of the spring for controlling notched cam 24 can occur only up to the point at which the left side of notched cam 24 is stopped by a resistance wall 27. Notched cam 24 is fabricated out of a similar plastic to that of rotor 20, and its spring 25, a flat wire spring shown in FIG. 3, is similarly mounted below its base. Notched cam 24 has a specially contoured notch 28 running along its interior perimeter edge, as illustrated in FIG. 2. The shape of notch 28 is critical to the operation of slow socket switch 10, and its function will become clearer from the description below.

A conducting rotor arm 30, preferrably of copper alloy, is provided. Rotor arm 30 is an elongated bar which has a transverse pin 32 at one end. Pin 32 rides in notch 28 in the perimeter of cam 24. The other end of rotor arm 30 slides back and forth in a bearing 34 mounted on top of disc 20, such that rotor arm bearing 34 rotates as rotor disc 20 rotates. Thus, as the pin 32 of the rotor arm 30 moves in notch 28 of cam 24, the other end of rotor arm 30 moves back and forth in rotor arm bearing 34.

The inside surface wall 27 is embedded with a resistive material over a horizontal arc of approximately 90° . If the rotor is presumed to occupy "nine o'clock" position in the socket housing 12 in FIG. 2, then the resistive material covers approximately the "nine" to "twelve o'clock" position. Current can be assumed to enter the housing at the position of screw and nut terminal 38, at the "nine o'clock" position, and then reaches to the corner 39 from which the resistive lining 27 begins. It should also be noted that the same kind of resistive lining could be embedded along the left bottom surface of cam 24 for smooth and slow turn-off operation of slow socket switch 10 if desirable. However, a slow turn-off operation is not so important as much as a slow turn-on operation for reduced filament fatique. More will be discussed later on the selection of resistive material.

Rotor arm 30 is electrically connected to the central contact of a light bulb through the axis of rotor 20 and through spring panel 40, as shown in FIG. 4.

To turn switch 10 to its off position 29, the operator would pull chain 16, causing rotor 20 and rotor arm 30 to turn about their axis against the resistive force of spring 22. As the rotor pin 32 moves in the notch 28 of cam 24, the electrical contact with the corner 39 is broken and the light slowly goes off. At the end of pulling action rotor pin 32 comes to rest in the "idle" region 29, of notch 28, approximately half-way to its maximum possible rotation angle.

To turn switch 10 to its on position, the operator pulls chain 16 which causes rotor arm pin 32 to continue to move in notch 28, until it reaches its maximum possible clockwise rotation. At this point the operator releases chain 16 and the rotor pin begins to travel back along the upper portion of the notch 28, in response to the force of spring 22. This motion is resisted by the counter force of return spring 26 under notched cam 24, which forces the notched cam 24 against the side wall 27. This resistance slows the rate at which rotor arm 30 and its pin 32 can complete their traversal of notch 28 in cam 24. As rotor pin 32 move along between cam 24 and wall 27, current begins to flow in the light bulb circuit, and this current gradually increases in magnitude as the distance between the corner 39 and pin 32 of rotor arm 30 decreases. When pin 32 hits the corner 39, the circuit is complete and slow socket switch is now in the "on" position illustrated in FIG. 2.

FIGS. 3 and 4 illustrate modifications required for a pushbutton switch. Reading FIGS. 3 and 4 together, when lever 18 is in its "down" position, it compresses spring 42 which pulls a string 44 around a fixed pin 46. This is analogous to the action of pulling chain 16, as described previously. When the operator releases lever 18, spring 42 can expand and rotor arm 30 can move in a counterclockwise direction due to the force of spring 22.

It may thus be seen that the present invention provides a novel means to permit the slow build up of electrical current when closing a switch. While several embodiments have been illustrated and described, it is apparent that many variations may be made in the particular form and procedure without departing from the scope of claims.

I claim:

1. A slow socket switch for installation within the sockets of light bulbs to allow electrical current to build up gradually comprising:

a spring loaded disc rotor in suitable electrical contact with the base of a light bulb socket;

a rotor spring tending to impart a counter-clockwise rotation to said disc rotor;

switch means to cause said spring-mounted disc rotor to rotate about its axis;

a spring loaded notched cam rotatably mounted in the base of said light bulb socket and in suitable electrical contact at its periphery with a resistive lining along the interior wall of said light bulb socket;

said spring loaded notched cam having a parabolic external peripheral edge which is not concentric with the interior sidewall of said lightbulb socket;

said cam spring tending to impart a clockwise rotation to said notched cam, thereby opposing the spring force of said rotor spring;

a rotor arm slidably received at one end in a bearing on said disc rotor and in suitable electrical contact therewith;

a rotor pin at the opposite end of said rotor arm positioned such that the movement of said rotor pin in an arcuate direction will force the movement of exterior perimeter edge of said notched cam slowly along said resistive lining, thus gradually closing said slow socket switch;

a pair of terminal contact points which define the limits of the fully open and fully closed position of said slow socket switch.

2. The slow switch of claim 1 wherein the means to cause said disc rotor to rotate is a pull chain secured to the axis of said rotor.

3. The slow switch of claim 1 wherein the means to cause said disc rotor to rotate is a spring loaded sliding switch connected to the axis of said rotor by a string passing around fixed pins.

* * * * *